US010961050B2

(12) United States Patent
Cohan

(10) Patent No.: US 10,961,050 B2
(45) Date of Patent: Mar. 30, 2021

(54) HANDS-FREE HOUSEHOLD WASTE AND RECYCLING DISPOSAL DEVICE

(71) Applicant: Joshua Adler Cohan, Sherman Oaks, CA (US)

(72) Inventor: Joshua Adler Cohan, Sherman Oaks, CA (US)

( * ) Notice: Subject to any disclaimer, the term of this patent is extended or adjusted under 35 U.S.C. 154(b) by 41 days.

(21) Appl. No.: 16/233,212

(22) Filed: Dec. 27, 2018

(65) Prior Publication Data

US 2019/0202633 A1 Jul. 4, 2019

Related U.S. Application Data

(60) Provisional application No. 62/610,948, filed on Dec. 28, 2017.

(51) Int. Cl.
*B65F 1/16* (2006.01)
*B65F 1/00* (2006.01)

(52) U.S. Cl.
CPC ..... *B65F 1/163* (2013.01); *B65F 1/0053* (2013.01)

(58) Field of Classification Search
CPC ..... B65F 1/163; B65F 1/0053
USPC ..... 220/262–264, 908
See application file for complete search history.

(56) References Cited

U.S. PATENT DOCUMENTS

| | | | | | |
|---|---|---|---|---|---|
| 3,028,015 | A * | 4/1962 | Williams | B65F 1/1421 | 211/83 |
| 4,892,218 | A * | 1/1990 | Reiling | B65F 1/163 | 220/263 |
| 6,010,024 | A * | 1/2000 | Wang | B65F 1/163 | 220/23.87 |
| 6,039,200 | A * | 3/2000 | Armor | B65F 1/163 | 220/263 |
| 2003/0183633 | A1* | 10/2003 | Pope | B65F 1/163 | 220/263 |
| 2009/0250463 | A1* | 10/2009 | Van Risseghem | B65F 1/163 | 220/263 |
| 2011/0089179 | A1* | 4/2011 | Flewelling | B65F 1/006 | 220/524 |
| 2015/0028032 | A1* | 1/2015 | Flewelling | B65F 1/163 | 220/263 |

* cited by examiner

*Primary Examiner* — James N Smalley
(74) *Attorney, Agent, or Firm* — Alphapatent Associates, Ltd; Daniel J. Swirsky

(57) ABSTRACT

The subject matter discloses a trash bin device, comprising a first trash bin having a first hollow body, an aperture to the first hollow body, a first lid configured to close the aperture, said lid is connected to an axis connected to the first trash bin and moves in a rotational manner along said axis, a first pedal located in the vicinity of a lower portion of the first trash bin, said first pedal moves when pressed on, a raising mechanism configured to transfer movement of the first pedal to movement of the first lid along the axis, such that pressing on the first pedal results in raising the first lid and enabling inserting an article to the first hollow body. The pedal may be connected to an arm mechanism, a cord mechanism or an electrical mechanism for raising the lid.

5 Claims, 7 Drawing Sheets

HANDS-FREE HOUSEHOLD WASTE AND RECYCLING DISPOSAL DEVICE

FIELD

The present disclosure generally relates to trash bin, and more particularly relates to trash bins opened without using the hands.

BACKGROUND

An increasing number of municipalities in North America and around the world are requiring that citizens sort their garbage and recyclable material and deposit this material in municipally mandated, individually wheeled and hinge lidded containers. A growing number of cities are requiring that citizens also sort and separately dispose food waste and other compost. These waste sorting and disposal requirements stem from the concern about growing landfill waste, it being policy in many cities to reduce landfill waste by recycling food waste and other compost material, as well as plastics, newspapers, and a variety of other goods.

Presently, most trash, compost and recycling containers are stored outdoors. The trash companies must pick up their own trash bins and nothing can be added to the cans because of the trash companies' fork lifting device that empties the cans into the truck. There are many foot levers for indoor mini trash cans, not for bigger recycle bins located outdoors, which is the bigger issue. Animals, insects and trash combine to create an unsanitary and inconvenient and potentially dangerous environment for waste disposal. People could get bit by a bug, pinch a finger under the container's lid, get cut by glass while cleaning trash off the floor after the bag splits and the like.

U.S. Pat. No. 8,522,993 presents a device for opening/removing the lid from multiple recycle/trash bins, without use of the user's hands. The device comprises single outer arms pivotally connected to the lids of the multiple recycle bins, such that when lifting the single outer arm using a foot pedal, all lids will be removed and recycle bins will open.

SUMMARY

It is an object of the subject matter to disclose a trash bin device, comprising a first trash bin having a first hollow body, an aperture to the first hollow body, a first lid configured to close the aperture, said lid is connected to an axis connected to the first trash bin and moves in a rotational manner along said axis, a first pedal located in the vicinity of a lower portion of the first trash bin, said first pedal moves when pressed on and a raising mechanism configured to transfer movement of the first pedal to movement of the first lid along the axis, such that pressing on the first pedal results in raising the first lid and enabling inserting an article to the first hollow body.

In some cases, the trash bin device further comprises a second trash bin having a second hollow body, a second lid and a second pedal, wherein the pressing on the second pedal results in raising the second lid and enabling inserting an article to the second hollow body. In some cases, the raising mechanism comprises a rod extending from the first pedal to a distal end, said distal end is higher than a top end of the hollow body, said distal end is connected to the first lid.

In some cases, the trash bin device further comprises a first pedal pulley connected to the first pedal, wherein the first pedal pulley moves along a pulley axis in response to pressing on the first pedal, wherein the first pedal pulley is connected to a first distal pulley located higher than a top end of the hollow body, wherein the first distal pulley rotates in response to rotation of the first pedal pulley, wherein rotation of the first distal pulley results in raising the first lid. In some cases, the trash bin device further comprises a first main pulley connected to the first pedal pulley using a lateral pole, said first main pulley and the first pedal pulley are concentric, wherein the first pedal pulley is connected to the first distal pulley via the first main pulley. In some cases, the radius of the first main pulley is at least twice larger than a radius of the first pedal pulley.

In some cases, the trash bin device further comprises a first rod extending along a vertical axis of the hollow body, wherein the rod is connected to the first pedal pulley and to the first distal pulley. In some cases, the trash bin device further comprises a base having a flat bottom surface, wherein the first pedal is placed on the base, wherein the first rod extends upwards from the base.

In some cases, the trash bin device further comprises a first arm link connected to the first pedal using a link axis and a first arm pole connected on one side to the first arm link and on another side to the first lid, wherein pressing on the first pedal moves the first arm link, thus raising the first arm pole and raising the first lid to enable access to the hollow body.

In some cases, the arm link comprises a guide niche and the first arm pole comprises a protrusion member inserted inside the guide niche, wherein pressing the first pedal results in changing a location of the protrusion member inside the guide niche, thus raising the first arm pole.

In some cases, the first arm link moves rotationally around the link axis in response to pressing on the first pedal. In some cases, the first arm link has a first position when the first pedal is in rest and a second position when the first pedal is pressed, wherein a connection point between the first arm link and the first arm pole is higher when the first arm link is in the first position than when the first arm link is in the second position. In some cases, the first arm pole comprises a raising member extending laterally from a top section of the first arm pole, said raising mechanism is configured to raise the first lid in response to raising the first arm pole.

In some cases, the first pedal is a touch-operated pedal. In some cases, the trash bin device further comprises a raising rod connected to the first lid and an electrical mechanism for raising the raising rod in response to detecting press on the touch-operated pedal.

BRIEF DESCRIPTION OF THE DRAWINGS

The invention may be more clearly understood upon reading of the following detailed description of non-limiting exemplary embodiments thereof, with reference to the following drawings, in which.

The following detailed description of embodiments of the invention refers to the accompanying drawings referred to above. Dimensions of components and features shown in the figures are chosen for convenience or clarity of presentation and are not necessarily shown to scale. Wherever possible, the same reference numbers will be used throughout the drawings and the following description to refer to the same and like parts.

DETAILED DESCRIPTION

Illustrative embodiments of the invention are described below. In the interest of clarity, not all features/components of an actual implementation are necessarily described.

The subject matter discloses a trash bin opened using a pedal. The trash bin is of a significant size, for example at least 0.8 meters high. The trash bin is configured to be placed outside a family residence, and be emptied by a garbage truck. As small trash cans are opened using a pedal, keeping the trash bin open using a pedal is more difficult due to the weight of the trash bin's lid. Hence, the claimed subject matter discloses multiple embodiments to open the lid and keep the lid open while throwing garbage into the trash bin.

Figure 1:
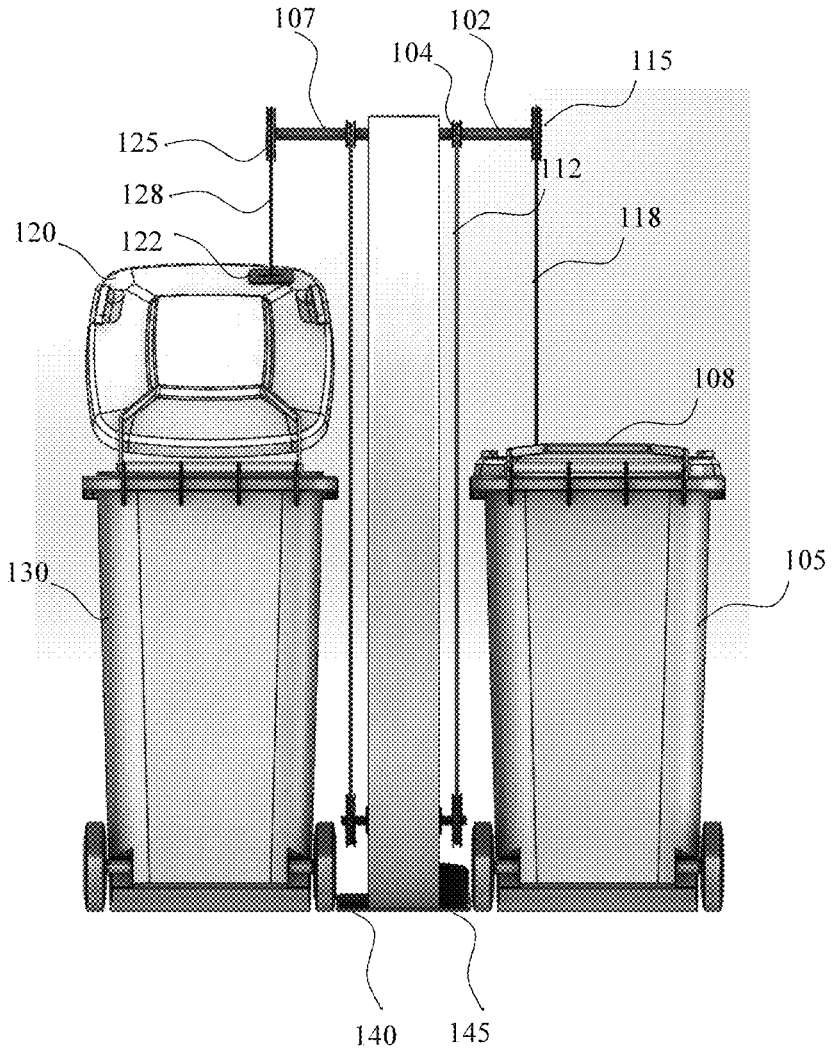
FIG. 1 shows a rear view of a trash bin system controlled by a leg pedal and a set of cords, according to exemplary embodiments of the subject matter.

FIG. 1 shows a rear view of a trash bin system controlled by a leg pedal and a set of cords, according to exemplary embodiments of the subject matter. The trash bin system comprises one or more trash bins. In the exemplary embodiment of FIG. 1, the trash bin system comprises two trash bins, a first trash bin 105 and a second trash bin 130. The first trash bin 105 comprises a first lid 108 and the second trash bin 130 comprises a second lid 120. The first lid 108 has a lid connector configured to secure a first lid cord 118 connected on one end to the lid connector and to another end to a first distal pulley 115 located higher than the first lid 108. Thus, when the user of the trash bin system wishes to throw garbage into a hollow volume of the first trash bin 105, the user presses a first pedal 145. The first pedal 145 is connected to the first distal pulley 115 via first main pulley 104. The first pedal 145 is connected to the first main pulley 104 via first cord 112. The first main pulley 104 and the first distal pulley 115 are connected to each other via a first lateral pole 102. This way, when the first pedal 145 is pressed, the first cord 112 is pushed and the first main pulley 104 rotates and generates rotation of the first lateral pole 102. Rotation of the first lateral pole 102 results in rotation of the first distal pulley 115 that raises the first lid 108. Similarly, pressing on the second pedal 140 results in rotating a second lateral pole 107, thus rotating a second distal pulley 125, and pulling a second lid cord 128. The second lid cord 128 is connected to a lid connector 122 of the second lid 120. It should be noted that the first lateral pole 102 and the second lateral pole 107 are not connected to each other, thus each of the poles 102, 107 rotate independently to each other. The cords 118, 112, 128 and additional cords disclosed in the subject matter may be made of synthetic materials, plastic materials, fabrics and any other material and breadth desired by a person skilled in the art.

Figure 2:
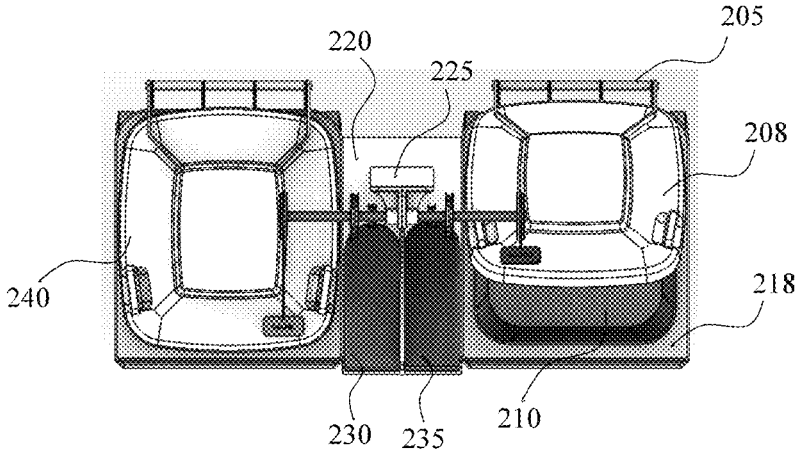
FIG. 2 shows a top view of a trash bin system controlled by a leg pedal and a set of cords, according to exemplary embodiments of the subject matter.

FIG. 2 shows a top view of a trash bin system controlled by a leg pedal and a set of cords, according to exemplary embodiments of the subject matter. The top view shows the two pedals 230, 235. One lid 240 is closed and another lid 208 is open, enabling persons to throw garbage to a hollow body 210. When the lid 208 is closed, the lid 208 rests on an upper surface 218 of the trash bin. The pedals 230, 235 are connected, either directly or indirectly, to a first rod 225 extending upwards from a base 220 to a distal end that is higher than the lids 208, 240. The cords mechanism enables the user to raise the lids by pressing the pedals. Thus, pressing the pedal 230 raises the lid 240 and pressing the pedal 235 raises the lid 208. The body of the trash bin comprises an axis 205 configured to enable rotational movement of the lids. The base 220 is configured to carry the cord mechanisms, the distal pulleys and the connectors between the distal pulleys and the first rod 225.

Figure 3:
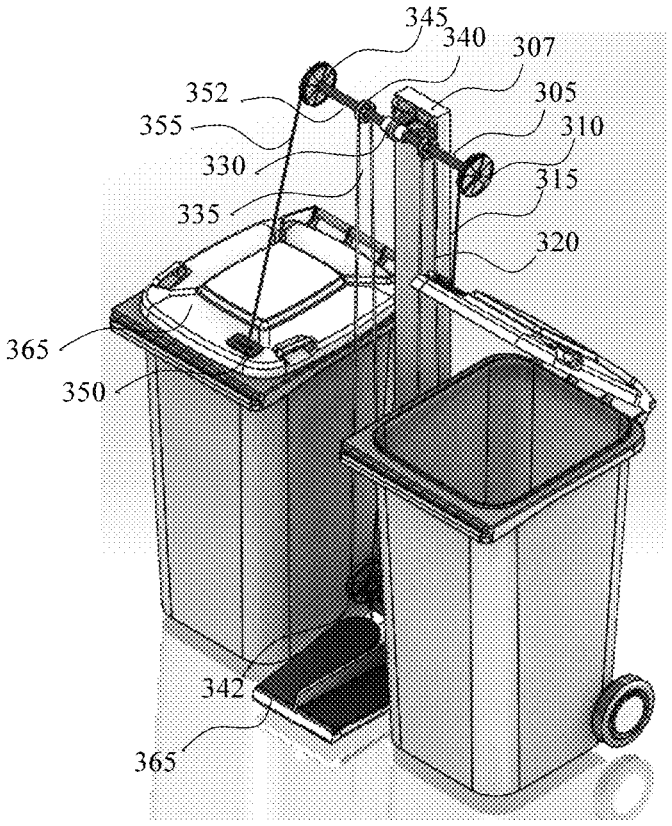
FIG. 3 shows an isometric view of a trash bin system controlled by a leg pedal and a set of cords, according to exemplary embodiments of the subject matter.

FIG. 3 shows an isometric view of a trash bin system controlled by a leg pedal and a set of cords, according to exemplary embodiments of the subject matter. FIG. 3 shows a distal part of the cord mechanism. When the user presses pedal 365, a pedal cord 335 rotates the pedal pulley 342. The pedal cord 335 is connected on one end to the pedal 365 and on another end to the pedal pulley 342. The pedal pulley 342 is connected to a main pulley 340 by the pedal cord 335. Thus, when the pedal pulley 342 rotates in response to pressing on the pedal, the main pulley 340 also rotates. The main pulley 340 is connected to distal pulley 345 using lateral pole 352. The first rod 307 is connected to two lateral rods 352, 305, each lateral rod is associated with another trash bin.

In operation, when the main pulley 340 rotates, the distal pulley 345 rotates to the same direction. The distal pulley 345 is connected to the lid connector 350 of the lid 365 using lid cord 355. This way, when the distal pulley 345 rotates, the lid cord is tensed and raises the lid 365. The two distal pulleys and the two main pulleys are secured to two main poles. The main poles are secured to the first rod 307 using a rod connector 330.

Figure 4:
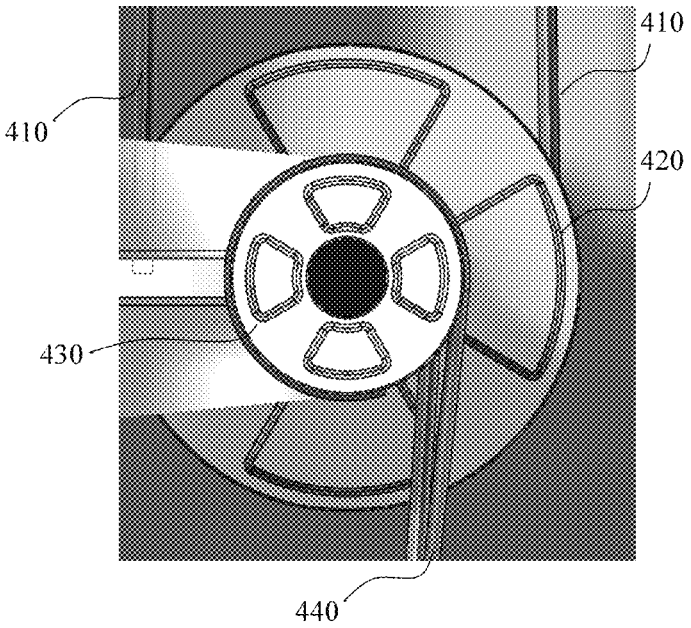
FIG. 4 shows a pedal pulley mechanism, according to exemplary embodiments of the subject matter.

FIG. 4 shows a pedal pulley mechanism, according to exemplary embodiments of the subject matter. The pedal pulley mechanism comprises two wheels 420, 430, having significantly different diameters. The first wheel 430 is smaller and is connected to a cord 440 connected to the pedal. The second wheel 420 is larger than the first wheel 430 and is connected to the pedal cord 410. The difference in size of the two wheels 420 and 430 enables a small movement of the pedal, and a small rotational movement in the first wheel 430 to be converted into a significantly larger movement of the second wheel 420, which eventually leads to a larger movement in the lid cord and larger opening in the trash bin.

Figure 5:
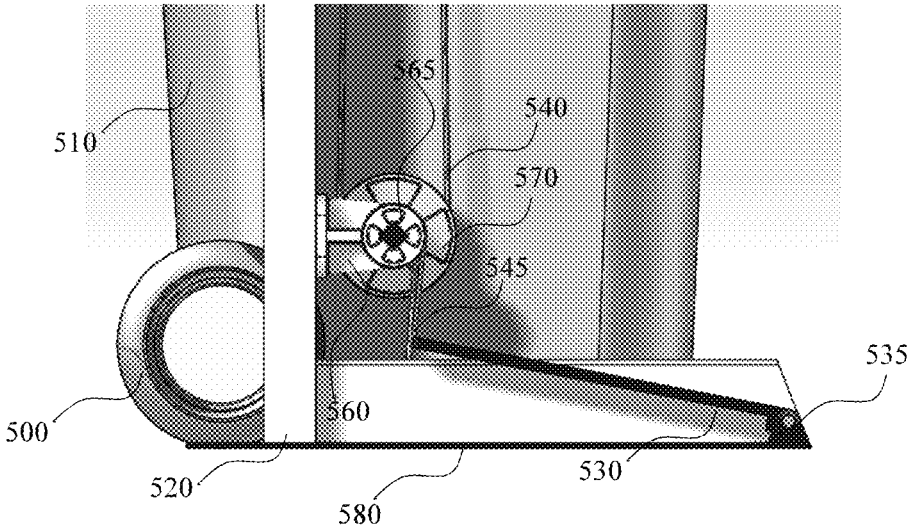
FIG. 5 shows a pedal pulley mechanism with the trash bin, according to exemplary embodiments of the subject matter.

FIG. 5 shows a pedal pulley mechanism with the trash bin, according to exemplary embodiments of the subject matter. The pedal 530 is movable around an axis 535. The pedal 530 may be connected to a base 580, or be located adjacently to the base 580. The first rod 520 extends upwards from the base 580. The first rod 520 has a distal portion, having the main pulley and the distal pulley. Thus, the first rod 520 is configured to be higher than the lid of the trash bin 510. The trash bin 510 has a wheel 500 facilitating the trash bin movement. The pedal pulley 570 is secured to the first rod 520 by a pedal pulley connector 560. The pedal pulley 570 is connected to the pedal 530 using a pedal cord 545. The pedal cord 545 is connected to the small wheel 565. The small wheel 565 is connected to the larger wheel 570 using a mechanism such as cogwheels, magnets, connectors and the like. The larger wheel 570 is connected to cord 540 which leads to the main pulley as noted above.

Figure 6:
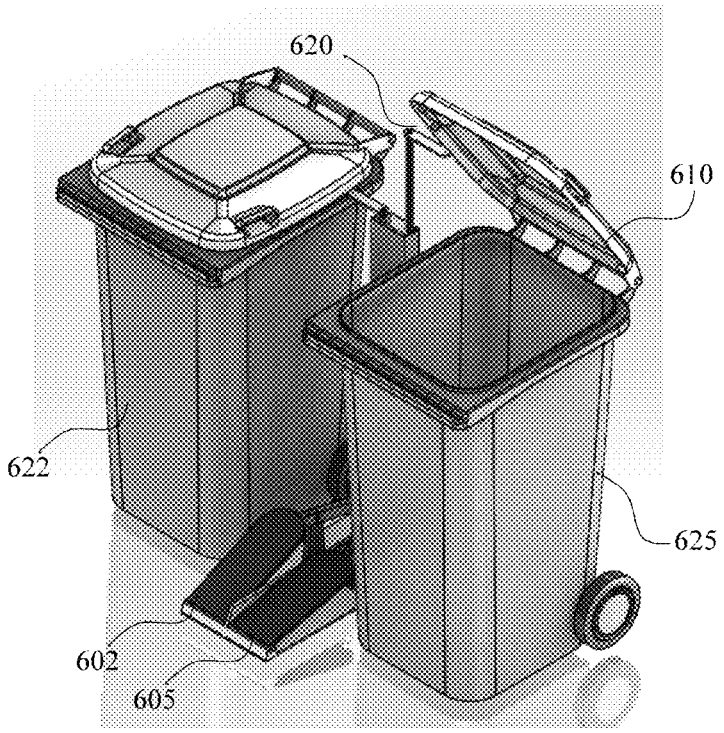
FIG. 6 shows a trash bin having a mechanism for raising the lids using arms, according to exemplary embodiments of the subject matter.

FIG. 6 shows a trash bin having a mechanism for raising the lids using arms, according to exemplary embodiments of the subject matter. The trash bins 622, 625 are opened by pressing the pedals 602, 605, respectively. The user throws garbage into the trash bin 625 when the lid 610 of the trash bin 625 is raised. The lid 610 is raised by arm 620. The arm 620 is pushed upwards by an arm mechanism disclosed in detail below. The arm 620 is mechanically coupled to the pedal 605. When the user presses the pedal 605, the arm 620 moves upwards and raises the lid 610.

Figure 7:
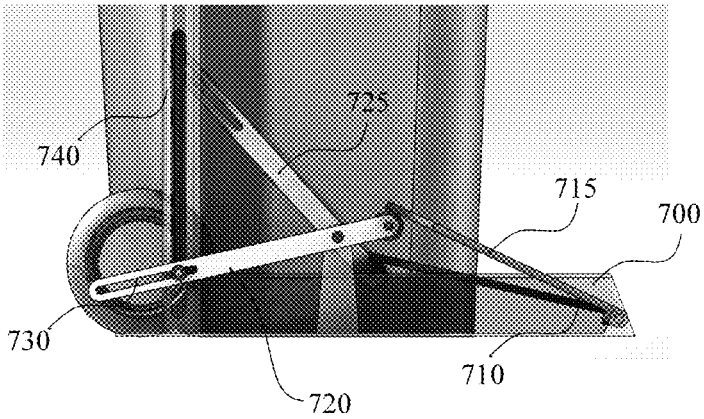
FIG. 7 shows a side view of an arm mechanism for raising the lids of the trash bin, according to exemplary embodiments of the subject matter.

FIG. 7 shows a side view of an arm mechanism for raising the lids of the trash bin, according to exemplary embodiments of the subject matter. Pedals 710 and 715 are connected to a base 700. The user may press one of the pedals 710, 715, or both pedals simultaneously. Each of the pedals 710, 715 is mechanically coupled to an arm link 725, 720, respectively. The pedal 710 may be connected to the arm link 725 via an axis. This way, pressing on the pedal 710 results in rotating the arm link 725 around the axis. The arm links 725, 720 have a proximal end connected to the pedals 710, 715 and a distal end connected to an arm pole 740. The arm pole 740 moves upwards and raises the lid. In some exemplary cases, the arm links 725, 720 have a niche, such as niche 730 of the arm link 720. The niche 730 is configured to host a protrusion member extending from the arm pole 740. This way, when the arm pole 740 rotates around the axis, or otherwise changes its angle relative to the base 700, the protrusion member slides along the niche 730 and the arm pole 740 moves upwards and raises the lid. In some cases, the protrusion member may be closer to the pedal when the pedal is in rest, and move farther from the pedal when the pedal is pressed.

Figure 8:
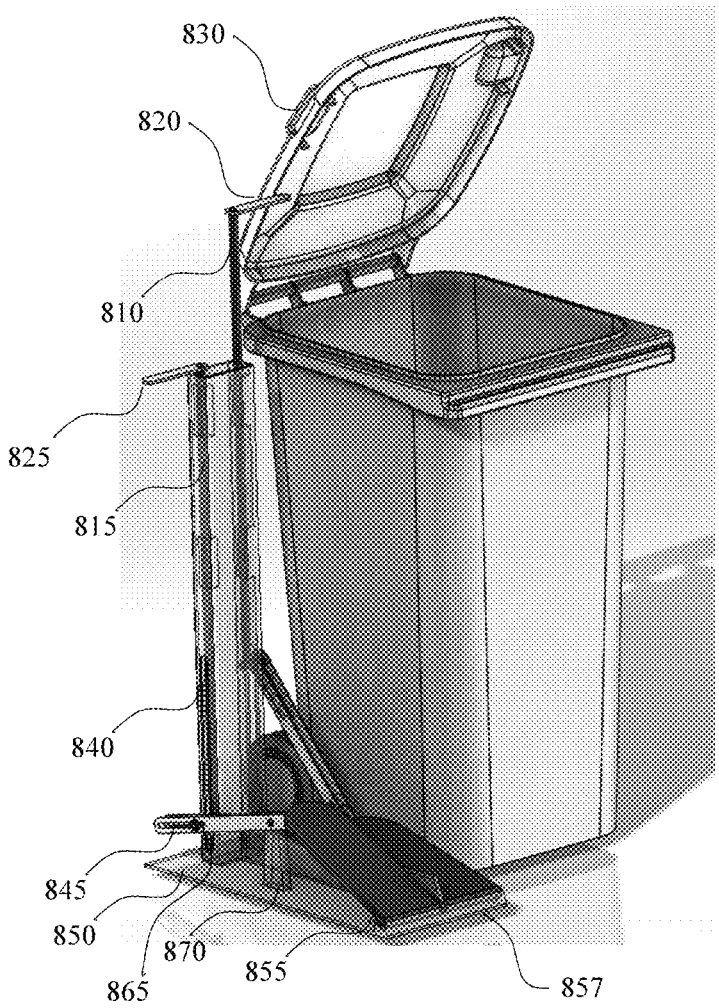
FIG. 8 shows an isometric view of an arm mechanism for raising the lids of the trash bin, according to exemplary embodiments of the subject matter; and, FIG. 9 shows a motorized mechanism for raising the lids of the trash bin, according to exemplary embodiments of the subject matter.

FIG. 8 shows an isometric view of an arm mechanism for raising the lids of the trash bin, according to exemplary embodiments of the subject matter. The lid 830 covers the hollow volume of the trash bin. The lid 830 is raised when the user wishes to throw garbage into the hollow volume. The lid 830 is raised when the arm pole 810 is raised. The arm pole 810 is coupled on one end to the pedal 857 and on another end to the lid 830. The arm pole 810 may have a secondary pole 820 extending laterally from the arm pole, configured to be placed below the lid 830. The secondary pole 820 is raised when the arm pole 810 is raised, thus raising the lid 830.

When the trash bin system comprises more than one trash bin, the trash bin system may comprise multiple arm poles, each arm pole is connected to a separate trash bin. The multiple arm poles may be placed in a single housing 865, enabling vertical movement of the arm poles. For example, housing 865 is configured to host arm poles 810 and 815. The arm pole 820 may have secondary pole 825, which is substantially equivalent to the secondary pole 820. The pedal 857 is coupled to arm pole 810 and the pedal 855 is coupled to arm pole 815. It is illustrated that the pedal 857 is pressed, the distal end of the arm link is raised, which moves the arm pole 810 upwards and raises the lid 830. As disclosed above, the arm poles 810 and 815 may comprise a protrusion member extending laterally from the arm poles 810 and 815. When pressing the pedal 855, the distal end of the arm link moves upwards, and the protrusion member may slide in a niche in the arm link, pushing the arm pole 815 upwards. When moving the arm poles 810 and 815 upwards, the protrusion member slides in a housing niche 840 of the housing 865.

The housing 865 extends upwards from a base 850. The base 850 may be placed on the ground, for example on a pavement or road. In some cases, the arm links are mounted on an arm base 870 located on the base 850. The arm base 870 provides height to the arm links, and a range of movement to the proximal side of the arm links, when pressing the pedals and lowering the proximal side of the arm links.

Figure 9:
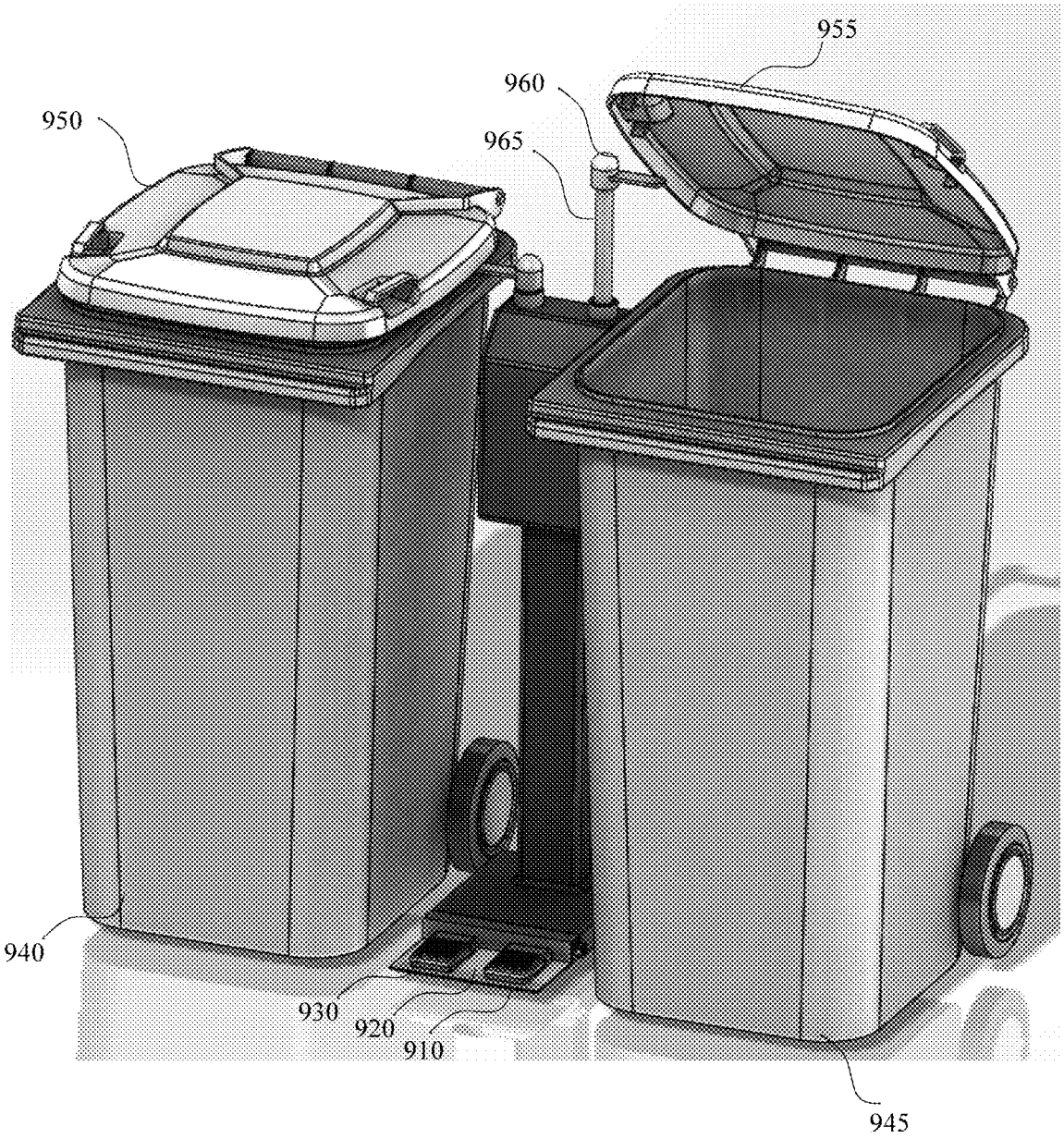

FIG. 9 shows a motorized mechanism for raising the lids of the trash bin, according to exemplary embodiments of the subject matter. FIG. 9 shows two trash bins 940 and 945, having lids 950 and 955, respectively. The lids 950 and 955 are removed when the touch-operated panels 910 and 930 are pressed. In some cases, pressing the panel 910 causes raising the lid 950 and pressing the panel 930 causes raising the lid 955. The panels 910 and 930 may be positioned on base 920. The panels 910 and 930 are electrically coupled to an actuating member, configured to raise the lids using a maneuverable arm, such as arm 965. For example, pressing on the panel 910 activates an actuator mechanism that moves the arm 965 upwards, thus raising the lid 955. In some cases, a secondary arm 960 extends laterally from the arm 965 and is in contact with the lid 955. Controlling the movement of the arm 965 may be implemented by an electrical controller functioning based on a predefined set of rules. In some other cases, the arm may move upwards as long as the panel 930 is pressed, or until the arm 965 reaches its top most position.

While the disclosure has been described with reference to exemplary embodiments, it will be understood by those skilled in the art that various changes may be made, and equivalents may be substituted for elements thereof without departing from the scope of the invention. In addition, many modifications may be made to adapt a particular situation or material to the teachings without departing from the essential scope thereof. Therefore, it is intended that the disclosed subject matter not be limited to the particular embodiment disclosed as the best mode contemplated for carrying out this invention, but only by the claims that follow.

What is claimed is:

1. A trash bin device, comprising:

a first trash bin having a first hollow body, an aperture to the first hollow body, a first lid configured to close the aperture, said first lid is connected to an axis connected to the first trash bin and moves in a rotational manner along said axis;

a first pedal located in the vicinity of a lower portion of the first trash bin, said first pedal moves when pressed on; and a raising mechanism configured to transfer movement of the first pedal to movement of the first lid along the axis, such that pressing on the first pedal results in raising the first lid and enabling inserting an article to the first hollow body, wherein the raising mechanism comprises a first arm link connected on a proximal end to the first pedal using an axis, a first arm pole substantially perpendicular to the ground, said first arm pole is connected to the first arm link on a distal end of the first arm link, and a secondary arm pole extending laterally from the first arm pole in a fixed position, a distal end of the secondary arm pole is located under the first lid, wherein pressing on the first pedal results in a rotational movement of the first arm link around the axis, such that the distal end of the first arm link moves upwards, and wherein the first arm pole and the secondary arm pole move linearly vertically upwards in response to upward movement of the first arm link.

2. The trash bin device of claim 1, further comprises a second trash bin having a second hollow body, and a second lid, wherein pressing on the first pedal results in raising the second lid and enabling inserting an article to the second hollow body.

3. The trash bin device of claim 1, wherein the first arm link comprises a guide niche and the first arm pole comprises a protrusion member inserted inside the guide niche, wherein pressing the first pedal results in changing a location of the protrusion member inside the guide niche, thus raising the first arm pole.

4. The trash bin device of claim 1, wherein the first arm link has a first position when the first pedal is in rest and a second position when the first pedal is pressed, wherein a connection point between the first arm link and the first arm pole is lower when the first arm link is in the first position than when the first arm link is in the second position.

5. The trash bin device of claim 1, wherein the secondary arm pole extends laterally from a top section of the first arm pole, said secondary arm pole is configured to raise the first lid in response to raising the first arm pole.

* * * * *